US008967271B2

(12) United States Patent
Lamison

(10) Patent No.: US 8,967,271 B2
(45) Date of Patent: Mar. 3, 2015

(54) SUBSEA OVERPRESSURE RELIEF DEVICE

(75) Inventor: Craig W. Lamison, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 316 days.

(21) Appl. No.: 13/490,637

(22) Filed: Jun. 7, 2012

(65) Prior Publication Data

US 2013/0327535 A1 Dec. 12, 2013

(51) Int. Cl.
*E21B 34/04* (2006.01)

(52) U.S. Cl.
USPC ..... 166/363; 166/364; 166/344; 166/345

(58) Field of Classification Search
USPC ..... 166/363, 364, 344, 337, 345, 368
See application file for complete search history.

(56) References Cited

U.S. PATENT DOCUMENTS

| | | | | |
|---|---|---|---|---|
| 3,500,841 | A * | 3/1970 | Logan | 137/13 |
| 3,666,100 | A * | 5/1972 | Madej | 210/800 |
| 3,745,773 | A * | 7/1973 | Cunningham | 405/60 |
| 4,004,531 | A | 1/1977 | Mott | |
| 4,318,442 | A * | 3/1982 | Lunde et al. | 166/357 |
| 5,730,166 | A | 3/1998 | Ackerley et al. | |
| 6,230,809 | B1 | 5/2001 | Korsgaard | |
| 6,390,114 | B1 | 5/2002 | Haandrikman et al. | |
| 6,739,804 | B1 | 5/2004 | Haun | |
| 6,820,696 | B2 | 11/2004 | Bergman et al. | |
| 7,905,251 | B2 | 3/2011 | Flanders | |
| 2006/0150640 | A1 | 7/2006 | Bishop | |
| 2010/0108321 | A1 * | 5/2010 | Hall et al. | 166/335 |
| 2012/0125623 | A1 * | 5/2012 | Cargol et al. | 166/344 |
| 2012/0211234 | A1 * | 8/2012 | Wilie et al. | 166/345 |
| 2012/0318529 | A1 * | 12/2012 | Herrold et al. | 166/375 |

FOREIGN PATENT DOCUMENTS

| | | | | |
|---|---|---|---|---|
| GB | 2066095 | A * | 7/1981 | B01D 19/00 |

* cited by examiner

*Primary Examiner* — James G Sayre
(74) *Attorney, Agent, or Firm* — Gary M. Machetta

(57) ABSTRACT

Systems and methods for relieving pressure from a subsea transport line are provided. The system can include a vessel having a bottom end that can be at least partially open and in fluid communication with a subsea environment. The vessel can also include one or more relief lines each having a first end and a second end. The first end can be coupled to one or more subsea transport lines coupled to one or more subsea production units and the second end can be coupled to a top end of the vessel. The relief line can include one or more pressure relief devices at least partially disposed therein.

18 Claims, 4 Drawing Sheets

SUBSEA OVERPRESSURE RELIEF DEVICE

BACKGROUND

1. Field

Embodiments described herein generally relate to systems and methods for subsea hydrocarbon production. More particularly, such embodiments relate to systems and methods for subsea pressure relief systems.

2. Description of the Related Art

Subsea production systems are widely used for producing oil and gas containing production fluids from deepwater fields. Subsea pipelines can be used to transport the production fluids from a wellhead to a receiving platform. Such fluids can include, but are not limited to, gaseous hydrocarbons, liquid hydrocarbons, additives (e.g., diluents added to heavy fluids and/or corrosion control additives), or any combination thereof. These pipelines typically rest on or near the ocean bottom and can extend for miles at depths exceeding 1,000 m of water. Periodically, such as during tropical storms, hurricanes, or other events (planned or unplanned), production can be halted with the support crew typically evacuated from the receiving platforms. Regulations may require various shut-in procedures which can involve the closing of valves, etc. Unstable conditions can occur during these shut-ins. For example, the pressure in a well can increase during a shut-in causing pressure increases within downstream equipment such as the subsea pipelines and/or risers and such pressure increase can cause the downstream equipment to rupture.

Subsea protection systems have been designed to address this problem. Specifically, high integrity pressure protection systems (HIPPS) have been used to protect against pressure increases. HIPPS, however, are complicated systems that include an array of piping, valves, control systems, and other equipment that can also fail during shut-ins. Additional, safety relief options include an offset riser, a relief riser, an additional HIPPS, and a pipe-in-pipe annulus relief. These options, such as an offset riser and relief riser can add considerable expense to a project. Also, an additional HIPPS can overcomplicate the subsea processing arrangement.

There is a need, therefore, for new systems and methods for subsea pressure relief systems.

DETAILED DESCRIPTION

Systems and methods for relieving pressure from a subsea transport line are provided. The subsea overpressure relief system can include a vessel having a bottom end that can be at least partially open and in fluid communication with a subsea environment. The vessel can include a relief line having a first end and a second end. The first end can be coupled to one or more subsea transport lines coupled to one or more subsea production units. The second end can be coupled to a top end of the vessel and the relief line can include one or more pressure relief devices at least partially disposed therein. The method can include flowing a fluid through the subsea transport line, where a relief line can be coupled to and in fluid communication with the transport line, and where the relief line can have at least one asymmetrical rupture disk at least partially disposed therein. The method can also include rupturing the asymmetrical rupture disk when the pressure of the fluid exceeds a predetermined pressure such that at least a portion of the fluid in the transport line can be diverted through the relief line and the ruptured asymmetrical rupture disk at least partially disposed therein. The method can also include flowing the portion of the fluid from the relief line into a substantially vertically oriented vessel that can be coupled to and in fluid communication with the relief line. The vessel can include a top end and one or more sidewalls having an open bottom end terminating into a subsea environment. The method can further include stopping the flow of the fluid through the relief line and removing at least a portion of the fluid in the vessel via a gas injection line coupled to the top end of the vessel.

Figure 1:
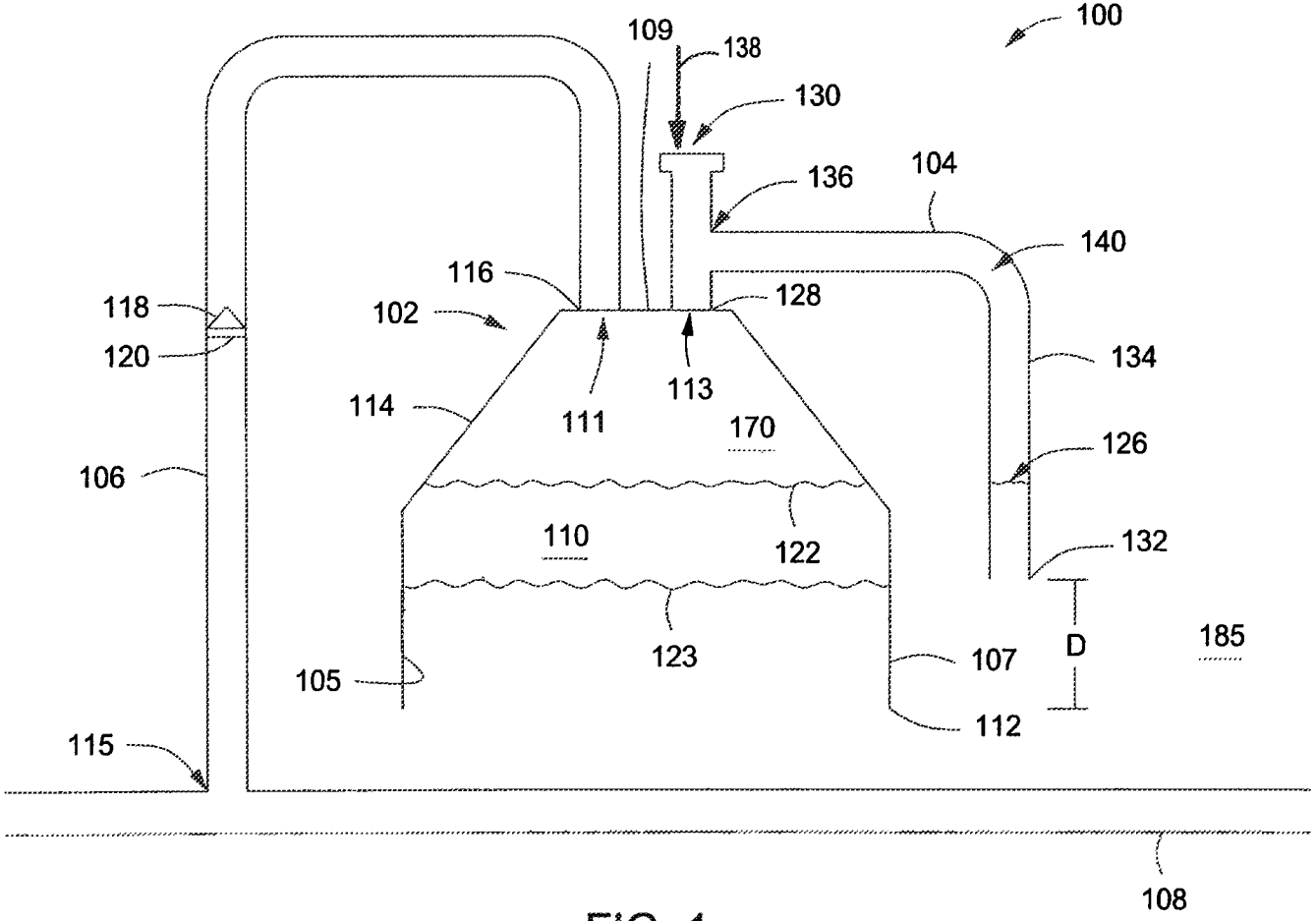
FIG. 1 depicts a cross-sectional, elevational side view of an illustrative subsea pressure relief system for subsea environments, according to one or more embodiments described.

FIG. 1 depicts a cross-sectional, elevational side view of an illustrative pressure relief system 100 for subsea environments 185, according to one or more embodiments. The pressure relief system 100 can include one or more vessels 102, one or more vent lines 104, one or more relief lines 106, and one or more pressure relief mechanisms or devices 118. The vessel 102 can have an inner surface 105 that at least partially defines an interior volume 110. The vessel 102 can have an inner cross-sectional shape that can be rectangular, multi-sided, elliptical, circular, oval, or any combination thereof. Depending, at least in part, on the configuration of the inner surface 105, the inner surface 105 can at least partially form an interior volume 110 having, for example, a rectangular, cylindrical, spherical, ellipsoidal, spheroidal (e.g., prolate or oblate), frusto-conical, and/or a shape functionally similar to a frusto-conical configuration. The interior volume 110 can include a variable containment zone 170. The variable containment zone 170 can be at least partially defined by a liquid level or liquid surface 122 or interface surface 123 depending on the composition of the pressurized product to be captured by the device.

The vessel 102 can be in open fluid communication with the subsea environment 185. For example, a second or "bottom" end 112 of the vessel 102 can be in open fluid communication with the subsea environment 185. The bottom end 112 can include a screen, grating, tray or other structure or combination of structures designed to allow fluid to flow therethrough or therepast and prevent particles or solids of a predetermined size from passing therethrough. As used herein, the terms "subsea environment," "subsea," and "subsea" are used interchangeably and refer to the environment of a volume of water below a surface of a body of water.

The vessel 102 can be in fluid communication with one or more transport lines or transport conduits 108. The transport line 108 can include risers or other production fluid transport lines, umbilicals, hydraulic lines or any other line containing a fluid under pressure. The transport line 108 can be located subsea, on an offshore platform, in the ground or earth, and/or on land. For example, the transport line 108 can include one or more conduits or pipelines in fluid communication with one or more subsea production units, such as a subsea wellhead. In another example, the transport line 108 can be or include an underground casing, riser, drill string, wellbore, or the like to which a wellhead or other equipment can be connected to for the production of hydrocarbons. The relief line 106 can be coupled to the transport line 108 at any location along the transport line 108. For example, the relief line 106 can be coupled to the transport line 108 at a location on or near a sea floor.

The vessel 102 can have a first or "top" end, 109. The top end 109 of the vessel 102 can be at least partially enclosed. For example, the top end 109 can include one or more inlet ports 111 and one or more outlet ports 113. Ports 111 and 113 can be disposed at any location along or about the top end 109. For example, ports 111 and 113 can be disposed at or near the center of the top end 109. The relief lines 106 and the vent lines 104 can be in fluid communication with the inlet ports 111 and the outlet ports 113, respectively. The relief line 106 can include one or more first ends 115 and one or more second ends 116. The first end 115 can be coupled to transport line 108 at any location along the transport line 108. The second end 116 can be coupled to the vessel 102 at any location along the top end 109 or the sidewalls 105 of the vessel 102. For example, the second end 116 can be coupled to the vessel 102 via the inlet port 111.

In one or more embodiments, the vessel 102 can have an internal volume 110 ranging from about 1 $m^3$ to about 10,000 $m^3$, about 10 $m^3$ to about 5,000 $m^3$, about 30 $m^3$ to about 1000 $m^3$, or about 50 $m^3$ to about 500 $m^3$. The size of the vessel 102 can permit the vessel to contain at least a portion of an oil spill from leaking into the surrounding environment and/or to the surface. The size of the vessel can be determined by performance requirements and economic factors rather than technical limitations.

The pressure relief device 118 can be disposed at any location within the relief line 106 between the first end 115 and the second end 116. Any number of pressure relief devices 118 can be at least partially disposed within the relief line 106. For example, the relief line 106 can include 1 or more, 2 or more, 3 or more, 4 or more, or 5 or more pressure relief devices 118 at least partially disposed therein. In another example, the relief line 106 can include less than 10, less than 6, less than 4, or less than 3 pressure relief devices 118 at least partially disposed therein. For example, the relief line 106 can include from 1 to 8, from 2 to 6, or from 2 to 4 pressure relief devices 118. The pressure relief device 118 can include any type of mechanism, valve, or other structure suitable for reducing pressure within a line, Illustrative, pressure relief devices 118 can be or include, but are not limited to, rupture disks, pressure relief valves, safety valves, and the like, and any combination thereof. The pressure relief device 118 can have an actuation pressure or rupture pressure less than a failure pressure of the transport line 108 and the relief line 106.

The pressure relief device 118 can be a rupture disk. The rupture disk can be formed from any desired material. For example, the rupture disk can be formed from carbon steel, stainless steel, graphite, Hastelloy®, or any combination thereof. The material(s) from which the rupture disk can be formed from can be capable of rupturing, bursting, breaching, puncturing, breaking, fracturing, or otherwise failing under pressure. The material(s) from which the rupture disk can be formed from can be capable of rupturing, bursting, breaching, puncturing, breaking, fracturing, or otherwise failing under a predetermined pressure. The rupture disk can include grooves, weakened sections, and/or other features that can promote rupture. The predetermined pressure can be any desired pressure that can be less than a rupture or fail pressure of the transport line 108 and the relief line 106. For example, the rupture disk can withstand any pressure less than a rupture or fail pressure of the transport line 108 and the relief line 106. In another example, the rupture disk can be configured or adapted to rupture or burst at a pressure, e.g., a predetermined pressure, ranging from about 500 kPa to about 500,000 kPa, about 1,000 kPa to about 250,000 kPa, about 2,000 kPa to about 140,000 kPa, or about 3,000 kPa to about 100,000 kPa. The rupture disk can be configured or adapted to rupture at a specific predetermined pressure, e.g., 10,000 kPa, or within a predetermined range of a specific predetermined pressure, e.g., within about 500 kPa of 10,000 kPa.

Figure 2:
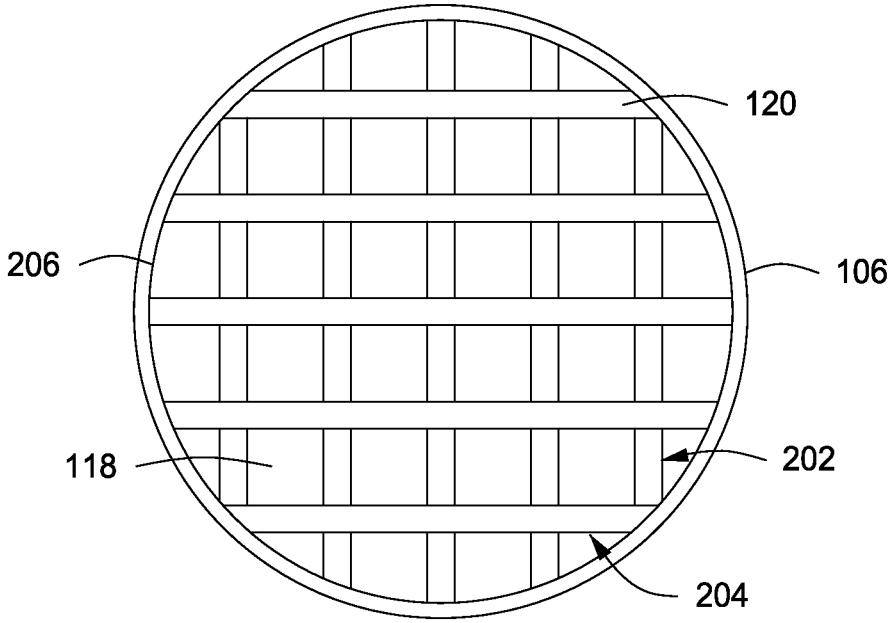
FIG. 2 depicts a cross-sectional view of an illustrative pressure relief device, according to one or more embodiments described.
Figure 3:
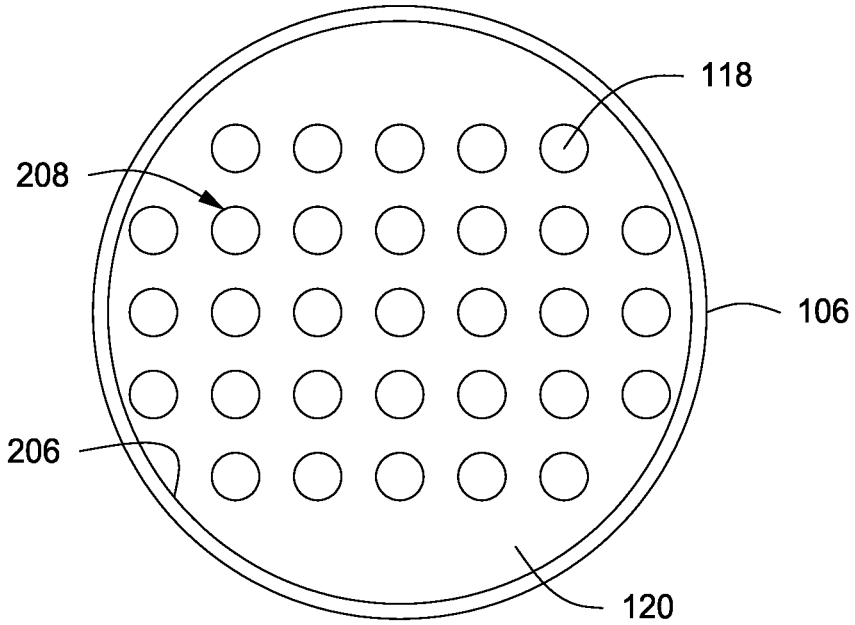
FIG. 3 depicts a cross-sectional view of another illustrative pressure relief device, according to one or more embodiments described.

The rupture disk can be or include an asymmetrical rupture disk, such that the rupture disk can rupture or burst in only one direction axial to the relief line 106. For example, an asymmetric rupture disk can rupture in a direction of fluid flowing from the transport line 108 and toward the vessel 102. The rupture disk can be prevented from rupturing in the opposite direction or in a direction of fluid flowing from the vessel 102 and toward the transport line 108, by a reinforcement means or backstop 120. The backstop 120 can be a structural element such as bars, a grid, a perforated plate, or any other structure that can be sufficient to prevent the rupture disk from rupturing in the direction of the backstop 120 and that can allow fluid to pass in the event the of rupture of the asymmetric rupture disk. For example, the backstop 120 can include a network of bars as shown in FIG. 2 and/or a one or more perforated plates as shown in FIG. 3.

The vessel 102 can an also include one or more sidewalls 107 in addition to the bottom end 112 and the top end 109. The bottom end 112 can be a distal end of the sidewalls 107 with respect to the top end 109. In another example, the sidewalls 107 can be disposed intermediate to the bottom end 112 and the top end 109. The top end 109 can have a cross-sectional area less than or equal to, or greater than the bottom end 112 and the sidewalls 107. In addition, a frusto-conical section 114 can be disposed intermediate the top end 109 and the sidewalls 107. In an example, the bottom end 112 can have a cross-sectional area greater than the cross-sectional area of the top end 109 and the sidewalls 107 can taper from the bottom end 112 to the top end 109, resulting in a continuously narrowing diameter from the bottom end 112 to the top end 109.

As discussed above, the vessel 102 can be at least partially opened at or near the bottom end 112 of the one or more sidewalls 105, such that the interior volume 110 of the vessel 102 can be in fluid communication with the subsea environment 185. For example, the bottom end 112 can be in open fluid communication with the subsea environment 185 such that liquid surface 122 of seawater or other liquid can form at or above the bottom end 112, between the one or more sidewalls 105. A hydrostatic pressure of the subsea environment 185 can be greater or less than an internal pressure within the vessel 102, thereby causing water from the subsea environment 185 to rise into the vessel 102 or fall, and form a liquid surface 122 within the vessel 102. An internal pressure can be present in the interior volume 110 of the vessel 102 above the liquid surface 122. The internal pressure can be at equilibrium with the hydrostatic pressure, providing the variable containment zone 170 with a stable bottom surface defined by the interface surface 123 which can be dependent on the liquid surface 122 and the volume and density of liquids in the vessel. When the internal pressure and the hydrostatic pressure are at equilibrium, the vessel 102 can have a static variable containment zone 170 that can be at least partially defined by the liquid surface 122.

The vessel 102 can be vertically or substantially vertically oriented. As used herein, the term "substantially vertical" refers to about −30 degrees to about 30 degrees, about −25 degrees to about 25 degrees, about −20 degrees to about 20 degrees, about −15 degrees to about 15 degrees, about −10 degrees to about 10 degrees, about −5 degrees to about 5 degrees, about −3 degrees to about 3 degrees, about −2 degrees to about 2 degrees, about −1 degree to about 1 degree, about −0.1 degree to about 0.1 degree, or about −0.0001 degree to about 0.0001 degree with respect to vertical longitudinal central axes of the vessel 102.

The vent line 104 can include a first end 128, a second end 132, and a gas injection port 130. The first end 128 can be coupled to the vessel 102 at any location. For example, the first end 128 can be coupled to the top end 109 of the vessel 102. In an example, the first end 128 can be coupled to the top end 109 proximate to where the pressure relief line 106 can be coupled to the top end 109. In another example, the first end 128 can be coupled to the top end 109 at a location below or above the location at which the relief line 106 can be coupled to the top end 109. In one or more embodiments, the first end 128 can be coupled to the outlet port 113. The vent line 104 can include one or more first ends 128 in which each first end 128 can be coupled to a corresponding one or more outlet ports 113.

The vent line 104 can include at least one vertical segment or substantially vertically oriented segment 134. In one or more embodiments, the vertical segment 134 can include the second end 132 of the vent line 104. For example, the vent line 104 can terminate at the vertical segment 134 into the subsea environment 185.

The second end 132 of the vent line 104 can terminate within the subsea environment 185. The second end 132 can be in open fluid communication with a subsea environment 185. In an example, the second end 132 can include one or more screens, one or more gratings, and/or one or more other structures designed to allow fluid to flow therethrough, but preventing solids of a predetermined size or dimension from passing therethrough. In one or more embodiments, an interior volume 140 of the vent line 104 can be partially defined by a liquid surface 126. The second end 132 can be in open fluid communication with subsea environment 185 such that a liquid surface 126 of seawater can form at or above the second end 132, within the vent line 104. A hydrostatic pressure of the subsea environment 185 can be greater than an internal pressure within the vent line 104, thereby causing water from the subsea environment 185 to rise into the vent line 104 and form the liquid surface 126 within the vent line 104. An internal pressure can be present in the interior volume 140 of the vent line 104 above the liquid surface 126. The internal pressure can be at equilibrium with the hydrostatic pressure, providing the interior volume 140 with a stable bottom surface defined by the liquid surface 126. When the internal pressure and the hydrostatic pressure are at equilibrium, the vent line 104 can have a static interior volume 140 that can be at least partially defined by the liquid surface 126.

The second end 132 of the vent line 104 and the bottom end 112 of the vessel 102 can be vertically offset from each other. In one or more embodiments, the second end 132 can be disposed at a location above the bottom end 112. For example, the second end 132 can be disposed at a distance D above the depth of the bottom end 112. The distance D can range from about 10 cm to about 10,000 cm, about 50 cm to about 5,000 cm, about 75 cm to about 2,000 cm, about 100 cm to about 1,000 cm, or about 250 cm to about 750 cm. In another example, the vertical segment 134 can have a height less than a height of the vessel 102. For example, the height of the vertical segment 134 range from about 1% to about 99%, about 5% to about 95%, about 10% to about 90%, about 20% to about 80%, about 30% to about 70%, or about 40% to about 60% less than the height of the vessel 102.

The gas injection port 130 can be disposed at any location along the vent line 104. For example, the gas injection port 130 can be coupled to the vent line 104 at a location near the outlet port 113. In one or more embodiments, the gas injection port 130 can be formed from the vent line 104 at a junction 136. The junction 136 can be disposed near the first end 128 of the vent line 104. In another example, the gas injection port 130 can be coupled directly to the vessel 102 at any location rather than being coupled to the vent line 104. For example, the gas injection port 130 can be coupled to the top end 109 of the vessel 102. In another example, the gas injection port 130 can be coupled to the top end 109, adjacent to where the pressure relief line 106 can be coupled to the top end 109. In another example, the gas injection port 130 can be coupled to the top end 109 at a location below or above the location at which the relief line 106 can be coupled to the top end 109. In a further example, the gas injection port 130 can be coupled to the outlet port 113.

The vessel 102 can function in a similar manner as a diving bell or an underwater habitat equipped with a moon pool. The internal pressure within the interior volume 110 of the vessel 120 can be at or about ambient pressure and thus directly related to subsea depth. The amount of hydrostatic force present under subsea conditions can determine the size and dimensions of the variable containment zone 170 within the vessel 102. As the hydrostatic force increases, the variable containment zone 170 compresses, and the water level within the vessel 102 rises resulting in the reduction in volume of the variable containment zone 170.

Once the vessel 102 is placed at a desired depth, the amount of interior volume 110 can be adjusted by means of compressed gas(es). In one or more embodiments, the compressed gas can include any inert or non-reactive gases. For example, the compressed gas can include air, carbon dioxide, argon, nitrogen, helium, or the like. The compressed gas can be supplied to the vessel 102 via a connecting hose or pipe (not shown). The compressed gas can be supplied to the vessel 102 at or just below the surface of the water level. For example, the compressed gas via line 138 can be supplied to the vessel 102 after the vessel 102 has been secured to a subsea processing unit, a subsea production unit, the seafloor, or other location. The compressed gas via line 138 can be introduced to the vessel 102 via the connecting hose, and the connecting hose can be connected to or coupled with the gas injection port 130. The compressed gas via line 138 can be injected into the interior volume 110 as the vessel 102 descends to a desired depth. In an example, the gas via line 138 can be injected into the interior volume 110 once the vessel 102 is in position at the seafloor or at a desired depth. In another example, gas via line 138 can be injected at or near the surface of a body of water prior to lowering the vessel to a desired depth. The relief line 106 and the vent line 104 can each include one or more valves (not shown). Any number of the valves may be in the actuated to a closed position when gas is introduced into the interior volume 110 of the vessel 102 in order to prevent the gas from escaping through the relief line 106 and the vent line 104.

The pressure relief apparatus 100 can be disposed near one or more wellheads (not shown). The one or more wellheads can be disposed subsea, on or near a seafloor. In one or more embodiments, the pressure relief apparatus 100 can be disposed near a riser (not shown) and/or near one or more subsea processing units, subsea production units, or the like (not shown). The subsea processing unit can include one or more risers or other production fluid transport lines. The transport line 108 can be coupled to or in fluid communication with the subsea processing unit, the subsea production unit, or the like. The transport line 108, fluidly coupled to the relief line 106, can include the risers and/or other production fluid transport lines. In one or more embodiments, the relief line 106 can be coupled to the transport line 108 that can contain production fluid. The pressure relief device 118 can fluidly isolate the vessel 102 from the production fluid in the transport line 108 before the pressure relief device 118 breaches, punctures, bursts, ruptures, or otherwise forms one or more flow paths therethrough.

In operation, the transport line 108 can contain one or more hydrocarbonaceous fluids or hydrocarbon-containing fluids or other fluids under pressurized conditions. The pressure of the fluid within the transport line 108 can vary, sometimes approaching or even exceeding the pressure rating the of the transport line 108, the relief line 106, or other lines, vessels, or apparatus in fluid communication with the transport line 108. The pressure relief device 118, e.g., a rupture disk, disposed in the relief line 106 can fail at a rupture pressure less than a rupture or fail pressure of the transport line 108, the relief line 106 or other lines, vessels, or apparatus in fluid communication with the transport line 108. As pressure in the transport line 108 and the relief line 106 exceeds the rupture pressure of the pressure relief device 118, the pressure relief device 118 can rupture, fail, or otherwise form one or more flow paths therethrough. After the pressure relief device 118 fails, the fluid contents of the transport line 108 can travel past the pressure relief device 118, through the remainder of the relief line 106 and into the vessel 102. The fluid contents can include solids, water, liquid hydrocarbons, and gases. The water and solid components of the fluid contents can mix with the water phase in the vessel 102 and thus enter the subsea environment 185. The liquid hydrocarbons (organic phase) and gases can fill the interior volume 110 of the vessel 102 above the interface surface 123. As the amount of liquid and/or gaseous hydrocarbons enter the vessel 102 increases, excess liquid hydrocarbons and/or gases can enter the vent line 104. The outlet port 113 of the vessel 102 can be generally disposed toward the top of the vessel 102 and the vented portion of the fluid can be primarily gaseous with the liquid portions remaining within the vessel variable containment zone 170 below the liquid level 122. The open second end 132 of the vent line 104 can terminate into the subsea environment 185 at a depth less than a depth of the open bottom end 112. A distance D between the depth of the second end 132 and the bottom end 112 can result in a lower hydrostatic pressure at the second end 132 than the bottom end 112. This pressure differential can result in the excess fluid exiting the vent line 104 before the pressure in the interior volume 110 can exceed the hydrostatic pressure at the bottom end 112, thus ensuring that the liquid surface 122 will remain inside the vessel 102. The hydrostatic forces acting against the incoming fluid can be less than the failure pressure of the transport line 108, the relief line 106, or other lines, vessels, or apparatus in fluid communication with the transport line 108. Thus, the failure of the rupture disk, for example, can prevent the failure of the transport line 108, the relief line 106, and/or or other lines, vessels, or apparatus in fluid communication with the transport line 108.

The production fluid introduced to the relief vessel 102 via the one or more relief lines 106 can be gas, liquid organic compounds, and/or particulates. As the production fluid enters the interior volume 110 of the vessel 102, the production fluid can begin to separate into two or more separate phases. For example, the production fluid can include a liquid water phase, an organic hydrocarbon phase, a gaseous phase, and/or a particulate or solids phase. The various phases can separate by gravity based on their relative densities. Heavier particulates can settle to the bottom where a collection device (not shown) could be located while gas, or gases, can rise to the top. A liquid gas interface 122 is shown but additional interfaces between liquids, such as interface surface 123, can exist below this interface. The separation between these liquid interfaces can be further enhanced by arranging the geometry of the relief line 106 and vessel 102 so as to impart a rotational motion to the production fluid with separation caused by a resulting radial force.

The gaseous phase can include hydrocarbon gases, such as methane, ethane, propane, butane, and the like. The gaseous phase can also include inert gases such as carbon dioxide, nitrogen, and the like. The organic phase can include hydrocarbons having from about 1 to about 36 carbon atoms, from about 2 to about 32 carbon atoms, from about 4 to about 28 carbon atoms, from about 8 to about 24 carbon atoms, or from about 12 to about 36 carbon atoms. The solids or particulates contained in the production fluid can include asphaltenes, sand, wax, hydrates, or any combination thereof.

The gaseous phase can be removed through the gaseous vent line 104 and/or through the gas injection port 130. For example, the gaseous phase can be removed from the vessel 102 via a designated gaseous phase removal line (not shown). The organic phase can be removed through the gaseous vent line 104 and/or through the gas injection port 130. For example, the organic phase can be removed from the vessel 102 via a dedicated organic phase removal line (not shown). The solids or particulates contained in the production fluid can include asphaltenes, sand, wax, hydrates, or any combination thereof.

The production fluid in relief line 106 can have a gas concentration ranging from a low of about 0 wt %, about 10 wt %, about 20 wt %, about 30 wt %, about 40 wt % to a high of about 50 wt % about, 60 wt %, about 75 wt %, about 90 wt %, or about 100 wt % based on the total weight of the production fluid in relief line 106. For example, the production fluid in relief line 106 can have a gas concentration ranging from about 1 wt % to about 99 wt %, about 5 wt % to about 95 wt %, about 10 wt % to about 90 wt %, about 20 wt % to about 80 wt %, about 10 wt % to about 60 wt %, about 25 wt % to about 45 wt %, about 50 wt % to about 90 wt %, or about 60 wt % to about 80 wt % based on the total weight of the production fluid in relief line 106. The production fluid in relief line 106 can have a liquid concentration ranging from a low of about 0 wt %, about 10 wt %, about 20 wt %, about 30 wt %, about 40 wt % to a high of about 50 wt % about, 60 wt %, about 75 wt %, about 90 wt %, or about 100 wt % based on the total weight of the production fluid in relief line 106. For example, the production fluid in relief line 106 can have a liquid concentration ranging from about 1 wt % to about 99 wt %, about 5 wt % to about 95 wt %, about 10 wt % to about 90 wt %, about 20 wt % to about 80 wt %, about 10 wt % to about 60 wt %, about 25 wt % to about 45 wt %, about 50 wt % to about 90 wt %, or about 60 wt % to about 80 wt % based on the total weight of the production fluid in relief line 106. The production in the relief line 106 can have a solids or particulates concentration ranging from a low of about 0 wt %, about 5 wt %, about 10 wt %, about 15 wt %, about 20 wt % to a high of about 25 wt % about, 30 wt %, about 40 wt %, about 45 wt %, or about 50 wt % based on the total weight of the production fluid in relief line 106. For example, the production fluid in relief line 106 can have a solids or particulates concentration ranging from about 1 wt % to about 50 wt %, about 2 wt % to about 40 wt %, about 2 wt % to about 25 wt %, about 5 wt % to about 20 wt %, or about 10 wt % to about 15 wt % based on the total weight of the production fluid in relief line 106. The production fluid in relief line 106 can have a water concentration ranging fro a low of about 0 wt %, about 5 wt %, about 10 wt %, about 25 wt %, about 30 wt % to a high of about 40 wt % about, 50 wt %, about 60 wt %, about 75 wt %, or about 90 wt % based on the total weight of the production fluid in relief line 106. The production fluid via relief line 106 can enter the vessel 102 upon the failure of the pressure relief device 118.

The variable containment zone 170 can include all material within the vessel 102 disposed above the interface surface 123. For example, the variable containment zone 170 can include an inert gas. The inert gas can include air, carbon dioxide, argon, nitrogen, helium, or the like. The variable containment zone 170 can also include the organic phase and/or the gaseous phase. The organic phase can contain hydrocarbons less dense than water and can rest above the organic phase surface 123. The gaseous phase can include any material in a gaseous phase at subsea pressures and can include any material present within the vessel 102 above the liquid surface 122. The variable containment zone 170 can include hydrocarbonaceous gases and/or liquids as well as water and particulates.

Referring now to FIG. 2, the backstop 120 can allow fluid to pass freely therethrough. For example, the backstop 120 can include a structure that results in a minimal pressure drop across the backstop 120. As depicted in FIG. 2, the backstop 120 can be a network of bars or a grid having lateral members 204 and transverse members 202 disposed immediately adjacent to or in contact with the pressure relief device 118. The lateral members 204 and the vertical members 202 can be sufficiently spaced apart from each other such that fluid can pass freely therethrough. The lateral members 204 and the vertical members 202 can be secured to an inner wall 206 of the relief line 106. In an example not shown, the grid can include any shape or orientation of support members. For example, support members (not shown) can be arranged diagonally resulting in a hexagonal void space between the support members.

As depicted in FIG. 3, the backstop 120 can be a perforated plate having a plurality of holes or perforations 208 disposed immediately adjacent to or in contact with the pressure relief device 118. The holes 208 can be of sufficient size and/or quantity that that fluid can pass freely therethrough. The perforated plate backstop 120 can be secured to the inner wall 206 of the relief line 106.

Figure 4:
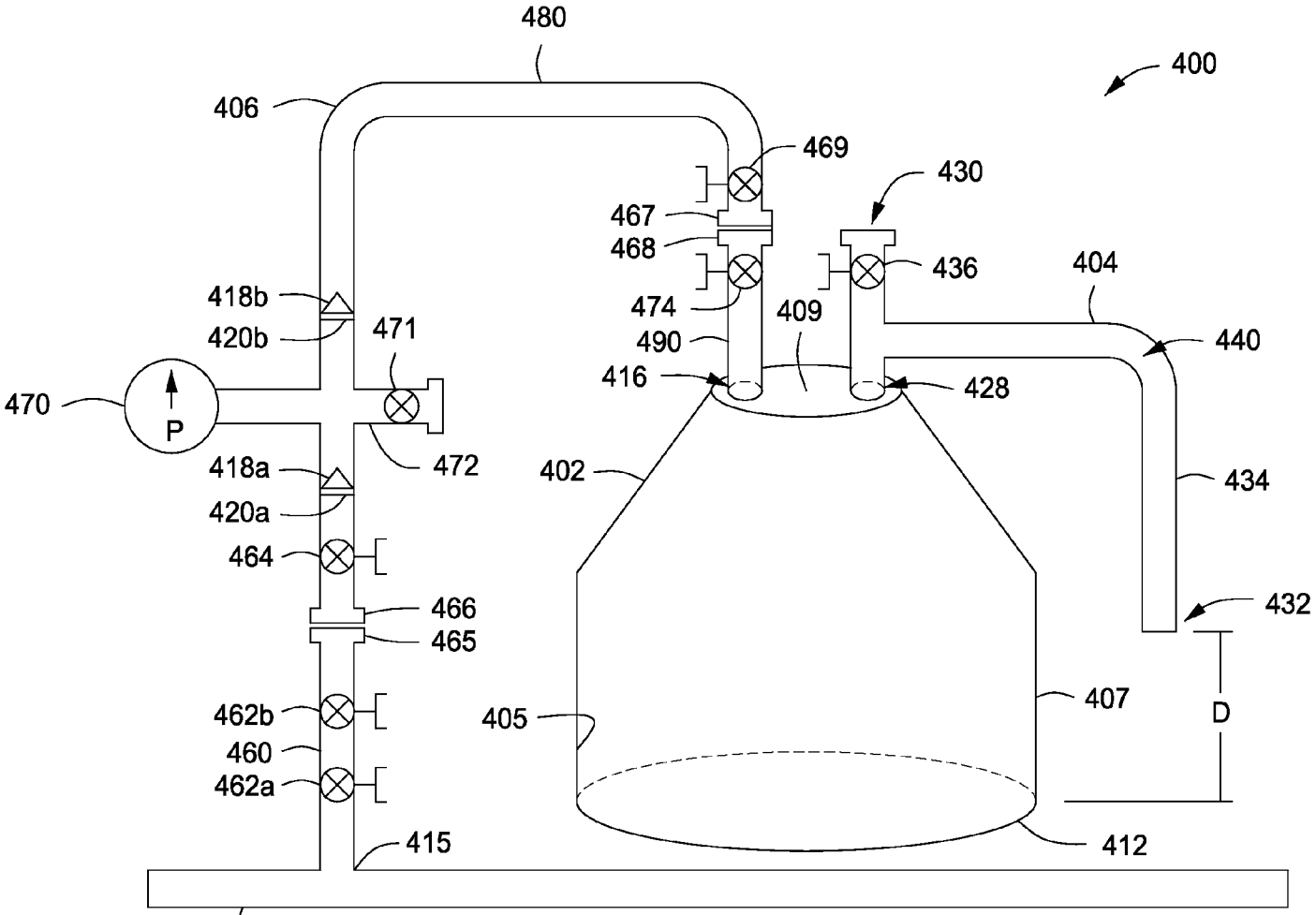
FIG. 4 depicts a cross-sectional, perspective side view of another illustrative subsea pressure relief system for subsea environments, according to one or more embodiments described.

FIG. 4 depicts a more detailed schematic of an illustrative pressure relief system 400, according to one or more embodiments. The relief system is shown having a vessel 402, a gaseous vent line 404, a relief line 406, and multiple relief mechanisms 418*a*, 418*b*. The vessel 402 can have an inner surface 405 that at least partially defines an interior volume 410. The vessel 402 can include one or more sidewalls 407, a bottom end 412, and a top end 409. For example, the sidewalls 407 can terminate in a subsea environment. As shown, the bottom end 412 can be a distal end of the sidewalls 407 from the top end 409, resulting in the vessel 402 being in open fluid communication with a subsea environment.

The vessel 402 can be connected to a transport line 408. A relief line 406 can be coupled to the transport line 108 at any location along the transport line 408. The vessel 402 can be coupled to the transport line 408 via the relief line 406. The relief line 406 can include a first end 415 and a second end 416. The first end 415 can be coupled to transport line 408 and the second end 416 can be coupled to the vessel 402 at the top end 409 of the vessel 402. At least one rupture disk (two are shown 418*a*, 418*b*) can be disposed within the relief line 406 at any location between the first end 415 and the second end 416 of the relief line 406.

The relief line 406 can include a first segment 460, a second segment 480, and a third segment 490. The first segment 460 can be coupled to the transport line 408, and the third segment 490 can be coupled to the top end 409 of the vessel 402. The first segment 460 and the third segment 490 can be joined via the second segment 480. The first segment 460 can be coupled to the second segment 480 via flanges, collet connectors, or other connection devices 465 and 466. The third segment 490 can be coupled to the second segment 480 via flanges, collet connectors, or other connection devices 467 and 468. The second segment 480 can include the rupture disks or relief devices 418*a*, 418*b*. The second segment 480 can also include a pressure indicator 470. The pressure indicator 470 can be disposed between the first rupture disk 418*a* and the second rupture disk 418*b*. An access line 472, having a valve 471, can also be disposed on the second segment 480 between the first rupture disk 418*a* and the second rupture disk 418*b*. The access line 472 can allow communication with the void between the rupture disks or relief devices 418*a* and 418*b* to introduce or remove fluid and adjust the fluids pressure for testing or operational purposes.

The first segment 460 can include one or more valves (two are shown 462*a*, 462*b*), the second segment 480 can include one or more valves (two are shown 464, 469), and the third segment 490 can include one or more valves (one is shown 474). When the rupture disks 418*a*, 418*b* need maintenance or repair, the second segment 480 can be removed from the first segment 460 and the third segment 490 via flanges 465, 466 and 467, 468. The second segment 480 can be raised to an offshore rig, platform, ship, or work boat, for example, for the maintenance and repair. During normal operation, the valves, 462*a*, 462*b*, 464, 469, and 474, are in an open position; however, to close the system for maintenance or repair, the valves 462*a*, 462*b*, 464, 469, and 474 can be closed. The vessel 402 can be supported by support members (not shown) independent of the relief line 406.

The vent line 404 can include a first end 428 and a second end 432. The vent line 404 can also include a gas injection port 430. The first end 428 can be coupled to the vessel 402 at the top end 409. The vent line 404 can include at least one vertical segment 434. The vertical segment 434 can be at least a portion of the vent line 404 that is at least substantially vertical. In one or more embodiments, the vertical segment 434 can include the second end 432 of the vent line 404. For example, the vent line 404 can terminate at the vertical segment 434 into the subsea environment.

The second end 432 and the bottom end 412 can be vertically offset from each other. In one or more embodiments, the second end 432 can be disposed at a location above the bottom end 412. For example, the second end 432 can be disposed at a distance D above the depth of the bottom end 412. The distance D can range from about 10 cm to about 10,000 cm, about 50 cm to 5,000 cm, about 100 cm to about 1,000 cm, or about 250 cm to about 750 cm.

The gas injection port 430 can be coupled to the vent line 404 at a location above the top end 409 of the vessel 402. The gas injection port 430 can be used to inject inert gas into the vessel 402 in order to provide a volume of gas within the vessel 402. The gas injection port 430 can also be used to withdraw gas phase and organic phase components that empty from the transport line 408 into the vessel 402. The gas injection port 430 can be opened and closed via a valve 436.

Figure 5A:
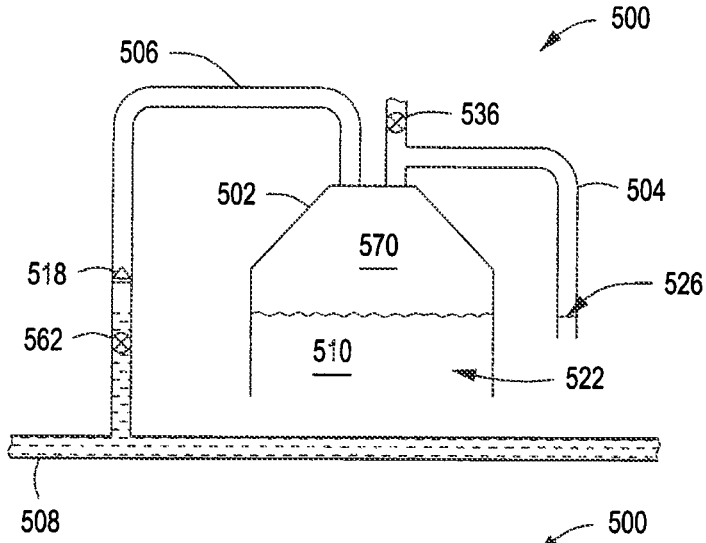
FIGS. 5A-C depict cross-sectional, elevational side views of an illustrative subsea pressure relief system showing different steps in a sequence of operation, according to one or more embodiments described.
Figure 5B:
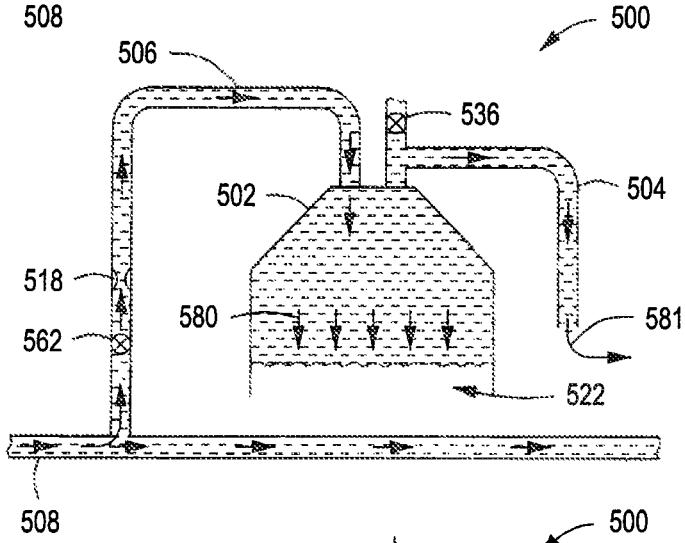
Figure 5C:
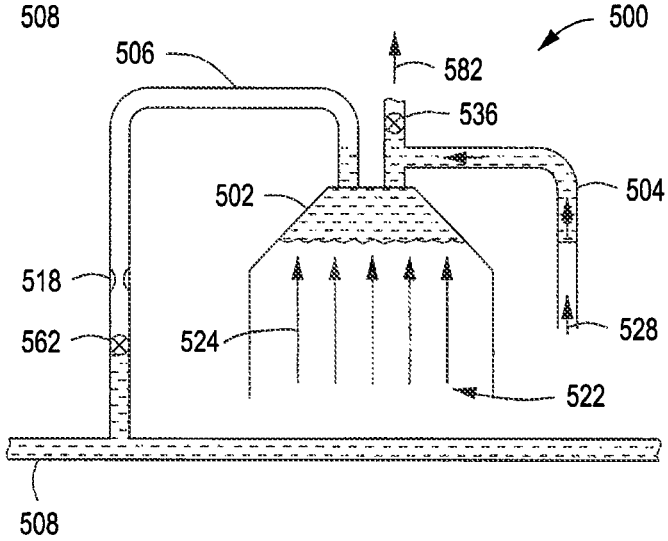

FIGS. 5A-5C depict an operation sequence of an illustrative subsea pressure relief system 500. In FIG. 5A, fluid under pressure can flow through transport line 508. The fluid in the transport line 508 can be present in the relief line 506 past the open valve 562 and up to the rupture disk 518. Compressed inert gas can occupy the remaining volume of the relief line 506, the variable containment zone 570, a portion of the interior volume 510 of the vessel 502, and a portion of the vent line 504. The valve 536 in vent line 504 can be closed to hold the compressed gas in the system 500.

As shown in FIG. 5B, when the pressure in the transport line 508 exceeds the rupture pressure of the rupture disk 518, the rupture disk 518 can rupture. The fluid in the transport line 508 can then escape and flow through the ruptured rupture disk 518 and the relief line 506 and into the vessel 502. As the fluid escapes from the transport line 508 and enters the vessel 502, pressure within the vessel 502 builds and pushes against the subsea hydrostatic forces as indicated by arrows 580, thus forcing the liquid level 522 downward. The fluid under pressure in the vessel 502 can escape into the gaseous vent line 504 and exit the system 500 as indicated by arrow 581.

In FIG. 5C, the valve 562 in the relief line 506 can be closed, and the valve 536 in the vent line 504 can be opened. This arrangement of the valves can allow for the fluid to be withdrawn from the system 500 (see arrow 582). The fluid can be withdrawn from the system 500 via a hose or pipe (not shown) that can be lowered from an offshore rig, platform, ship, or work boat, for example. The fluid can be withdrawn at least partially by aid of the hydrostatic forces pushing against the fluid in the vessel 502 (see arrows 524) and the vent line 504 (see arrows 528).

The valves, 562 and 536, can be opened and closed in any manner. For example, the valves, 562 and 536, can be linked to a control system and can be opened and closed from a remote location, such as an offshore platform or on-shore facility (not shown). In another example, the valves, 562 and 536, can be manually opened and closed by divers, submarines, ROVs (remotely operated vehicles) or other submersible vehicle.

The pressure relief device 118 can be manually and/or remotely activated to permit and/or prevent fluid flow therethrough. For example, the pressure relief device 118 can be manually opened and closed by divers, submarines, ROVs (remotely operated vehicles) or other submersible vehicle. In another example, the pressure relief device 118 can be linked to a control system and can be opened and closed from a remote location, such as an offshore platform or on-shore facility (not shown).

Embodiments of the present disclosure further relate to any one or more of the following paragraphs:

1. A subsea relief system, comprising: a vessel having a bottom end that is at least partially open and in fluid communication with a subsea environment; and a relief line having a first end and a second end, wherein the first end is coupled to one or more subsea transport lines coupled to one or more subsea production units, wherein the second end is coupled to a top end of the vessel, and wherein the relief line comprises one or more pressure relief devices at least partially disposed therein.

2. The system of paragraph 1, wherein the one or more pressure relief devices comprises one or more rupture disks, one or more pressure relief valves, or combinations thereof.

3. The system of paragraphs 1 or 2, wherein the vessel further comprises one or more sidewalls, and at least a portion of an inner surface of the one or more sidewalls has a frustoconical shape.

4. The system according to any one of paragraphs 1 to 3, wherein the one or more pressure relief devices comprises an asymmetrical rupture disk.

5. The system according to any one of paragraphs 1 to 3, wherein the asymmetrical rupture disk comprises a backstop disposed within the relief line between a rupture disk and the first end.

6. The system of paragraph 5, wherein the backstop causes the rupture disk to rupture in a direction away from the backstop.

7. The system according to any one of paragraphs 1 to 6, wherein the vessel is substantially vertically oriented.

8. The system according to any one of paragraphs 1 to 7, wherein the vessel comprises one or more sidewalls, and wherein the one or more sidewalls are at least substantially vertically oriented and terminate into the subsea environment forming the at least partially open bottom end.

9. The system according to any one of paragraphs 1 to 8, further comprising a vent line having a first end and a second end, wherein the first end of the vent line is coupled to the top end of the vessel, and wherein the second end of the vent line terminates within the subsea environment at a height above the bottom end of the vessel and below the first end of the vent line.

10. The system of paragraph 9, wherein the vent line comprises a substantially vertically oriented segment that comprises the second end.

11. The system according to any one of paragraphs 1 to 10, further comprising a gas injection line in fluid communication with the internal volume of the vessel.

12. The system of paragraph 9, wherein the gas injection line is coupled to the vent line at a location proximate the top end of the vessel, and wherein the gas injection line is adapted to fluidly connect with a conduit for introducing compressed gas to the vessel and removing hydrocarbons from the vessel.

13. A subsea relief system, comprising: a transport line having a hydrocarbon containing fluid flowing therethrough; a relief line having a first end coupled to the transport line and one or more asymmetrical rupture disks at least partially disposed therein; a substantially vertically oriented vessel comprising a top end, one or more sidewalls, and a bottom end terminating into a subsea environment, wherein a second end of the relief line is in fluid communication with the vessel; and a vent line having a first end in fluid communication with the vessel and a second end terminating into the subsea environment at a height above the bottom end of the vessel and below the first end of the vent line.

14. The system of paragraph 13, wherein the vent line comprises a substantially vertically oriented segment that comprises the second end.

15. The system of paragraphs 13 or 14, the height has a distance ranging from about 10 cm to about 10,000 cm.

16. The system according to any one of paragraphs 13 to 15, wherein the substantially vertically oriented vessel has an internal volume comprising a variable containment zone disposed above a liquid surface of a liquid phase disposed within the internal volume.

17. The system of paragraph 16, wherein the variable containment zone contains hydrocarbonaceous material and the liquid phase comprises water.

18. A method for relieving pressure in a subsea transport line, comprising: flowing a fluid through the transport line, wherein a relief line is coupled to and in fluid communication with the transport line, and wherein the relief line comprises at least one asymmetrical rupture disk at least partially disposed therein; rupturing the asymmetrical rupture disk when a pressure of the fluid exceeds a predetermined pressure such that at least a portion of the fluid in the transport line is diverted through the relief line and the ruptured asymmetrical rupture disk at least partially disposed therein; flowing the portion of the fluid from the relief line into a substantially vertically oriented vessel that is coupled to and in fluid communication with the relief line, and wherein the vessel comprises a top end and one or more sidewalls having an open bottom end terminating into a subsea environment; stopping the flow of the fluid through the relief line; and removing at least a portion of the fluid in the vessel via a gas injection line coupled to the top end of the vessel.

19. The method of paragraph 18, wherein the fluid comprises crude oil, water, hydrocarbonaceous gases, and carbonaceous solids and the fluid in the vessel separates into at least three distinct phases comprising a liquid phase, an organic phase, and a gaseous phase.

20. The method of paragraphs 18 or 19, further comprising injecting a gas into the vessel via the gas injection line prior to rupturing the asymmetrical rupture disk with the fluid.

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A subsea relief system, comprising:

a vessel having a bottom end that is at least partially open and in fluid communication with a subsea environment; and a relief line having a first end and a second end, wherein the first end is coupled to one or more subsea transport lines coupled to one or more subsea production units, wherein the second end is coupled to a top end of the vessel, wherein the relief line comprises one or more pressure relief devices at least partially disposed therein, wherein the one or more pressure relief devices comprises an asymmetrical rupture disk, and wherein the asymmetrical rupture disk comprises a backstop disposed within the relief line between a rupture disk and the first end.

2. The system of claim 1, wherein the one or more pressure relief devices further comprises one or more pressure relief valves.

3. The system of claim 1, wherein the vessel further comprises one or more sidewalls, and at least a portion of an inner surface of the one or more sidewalls has a frusto-conical shape.

4. The system of claim 1, wherein the backstop causes the rupture disk to rupture in a direction away from the backstop.

5. The system of claim 1, wherein the vessel is substantially vertically oriented.

6. The system of claim 1, wherein the vessel comprises one or more sidewalls, and wherein the one or more sidewalls are at least substantially vertically oriented and terminate into the subsea environment forming the at least partially open bottom end.

7. A subsea relief system, comprising:

a vessel having a bottom end that is at least partially open and in fluid communication with a subsea environment;

a relief line having a first end and a second end, wherein the first end is coupled to one or more subsea transport lines coupled to one or more subsea production units, wherein the second end is coupled to a top end of the vessel, and wherein the relief line comprises one or more pressure relief devices at least partially disposed therein; and a vent line having a first end and a second end, wherein the first end of the vent line is coupled to the top end of the vessel, and wherein the second end of the vent line terminates within the subsea environment at a height above the bottom end of the vessel and below the first end of the vent line.

8. The system of claim 7, wherein the vent line comprises a substantially vertically oriented segment that comprises the second end.

9. The system of claim 7, further comprising a gas injection line in fluid communication with the internal volume of the vessel.

10. The system of claim 9, wherein the gas injection line is coupled to the vent line at a location proximate the top end of the vessel, and wherein the gas injection line is adapted to fluidly connect with a conduit for introducing compressed gas to the vessel and removing hydrocarbons from the vessel.

11. A subsea relief system, comprising:

a transport line having a hydrocarbon containing fluid flowing therethrough;

a relief line having a first end coupled to the transport line and one or more asymmetrical rupture disks at least partially disposed therein;

a substantially vertically oriented vessel comprising a top end, one or more sidewalls, and a bottom end terminating into a subsea environment, wherein a second end of the relief line is in fluid communication with the vessel; and a vent line having a first end in fluid communication with the vessel and a second end terminating into the subsea environment at a height above the bottom end of the vessel and below the first end of the vent line.

12. The system of claim 11, wherein the vent line comprises a substantially vertically oriented segment that comprises the second end.

13. The system of claim 11, wherein the height has a distance ranging from about 10 cm to about 10,000 cm.

14. The system of claim 13, wherein the substantially vertically oriented vessel has an internal volume comprising a variable containment zone disposed above a liquid surface of a liquid phase disposed within the internal volume.

15. The system of claim 14, wherein the variable containment zone contains hydrocarbonaceous material and the liquid phase comprises water.

16. A method for relieving pressure in a subsea transport line, comprising:

flowing a fluid through the transport line, wherein a relief line is coupled to and in fluid communication with the transport line, and wherein the relief line comprises at least one asymmetrical rupture disk at least partially disposed therein;

rupturing the asymmetrical rupture disk when a pressure of the fluid exceeds a predetermined pressure such that at least a portion of the fluid in the transport line is diverted through the relief line and the ruptured asymmetrical rupture disk at least partially disposed therein;

flowing the portion of the fluid from the relief line into a substantially vertically oriented vessel that is coupled to and in fluid communication with the relief line, wherein the vessel comprises a top end and one or more sidewalls having an open bottom end terminating into a subsea environment;

stopping the flow of the fluid through the relief line; and removing at least a portion of the fluid in the vessel via a gas injection line coupled to the top end of the vessel.

17. The method of claim 16, wherein the fluid comprises crude oil, water, hydrocarbonaceous gases, and carbonaceous solids and the fluid in the vessel separates into at least three distinct phases comprising a liquid phase, an organic phase, and a gaseous phase.

18. The method of claim 16, further comprising injecting a gas into the vessel via the gas injection line prior to rupturing the asymmetrical rupture disk with the fluid.

* * * * *